United States Patent [19]

Zimeri Safie

[11] 3,964,368

[45] June 22, 1976

[54] AUTOMATIC PISTOL

[76] Inventor: Jorge Antonio Zimeri Safie, 13 Avenida 14/26 Zona 10, Guatemala City, Guatemala

[22] Filed: June 18, 1974

[21] Appl. No.: 480,594

[30] Foreign Application Priority Data

Oct. 24, 1973 Italy ..... 30488/73

[52] U.S. Cl. ..... 89/141; 89/14.1

[51] Int. Cl.[2] ..... F41D 11/02; F41D 11/20

[58] Field of Search ..... 42/69 B, 70 F; 89/132, 89/139, 140, 141, 142, 145, 149

[56] References Cited

UNITED STATES PATENTS

| | | | |
|---|---|---|---|
| 2,090,656 | 8/1937 | Williams | 89/145 |
| 3,750,531 | 8/1973 | Angell et al. | 42/70 F |

*Primary Examiner*—Stephen C. Bentley
*Attorney, Agent, or Firm*—Finnegan, Henderson, Farabow & Garrett

[57] ABSTRACT

An improved automatic pistol is provided with a lever mechanism which causes operation as a burst-firing arm in a safe and reliable manner. This is achieved by forming the disconnector, which releases the sear, with a chamfered and bent end, opposite to the end engaging said sear, in order to co-operate with a trigger bar which has two degrees of freedom in the usual repeating operation, and which is connected in an articulated manner to the pistol trigger. Through a 90° rotation of a selector member, a should on the trigger bar allows the trigger bar only one degree of freedom thus causing the disconnector, which is pivotedly mounted on the reciprocating breech mechanism, to enter into a tangential, instead of perpendicular contact through its bent and chamfered end with the trigger bar. Thus, the disconnector enables continuous firing of the pistol as long as the trigger remains is pressed. The breech mechanism is provided with a number of air intakes and is preferably of frusto-pyramidal shape for cooling the piston barrel.

6 Claims, 4 Drawing Figures

AUTOMATIC PISTOL

BACKGROUND OF THE INVENTION

The present invention relates to an improved automatic pistol and more properly a lever mechanism which, applied to an automatic pistol, allows it to be transformed into a burst-firing pistol.

It is known that in the field of military appliances, various studies have been effected in order to provide firearms which not only can be light and handy in function, but also have the possibility of burst-firing.

These firearms, although intended to be used by suitably trained military personnel, must necessarily be safe and reliable.

It has been found quite difficult to provide fire arms showing all the above stated features and therefore attempts previously made have not provided the intended results. In particular, the automatic pistols capable of burst-firing according to the prior art, employ mechanical devices having various degrees of freedom, their operation being strictly related to their wear, the length of their strokes and lubrication of the movable parts (i.e. to inertia of the moving elements).

A typical example of the inconveniences shown by the pistols of the prior art is given by the Spanish pistol "Star" of 1939. The burst-firing operation of this pistol is controlled by means of a ratchet actuated from the outside and mounted on the pistol.breech reciprocating mechanism. More precisely, such ratchet is capable of taking either of two positions, called A and B for distinguishing purposes. Whenever the ratchet is at position A, the pistol fires as any known repeating pistol. On the contrary, whenever it is located at the position B, the ratchet, driven by the breech mechanism during the reversal stroke of the hammer upon a pistol-shot, engages the end of a lever pivotally mounted on the breech mechanism. Such lever, according to the force of the blow received, can hit by its other end the hammer sear, thus disengaging it and causing burst-firing which depends on the rocking movement of the lever itself.

Actually it is possible that the lever does not hit the latch since this occurs according to the trigger position, namely it depends upon whether the trigger is pressed or released. In fact, the condition for the above mentioned lever to have room enough to hit against the latch only occurs if the trigger is pressed. From the above, it should be apparent to those skilled in the art that a similarly designed firearm is extremely unsafe. As a matter of fact; a very slight clearance of the lever mechanism described hereinabove may cause the pistol to fire an undesired burst when loaded with its ratchet at the position B. Furthermore, the described pistol, again with the ratchet at the position B, may fire a burst as a result of a casual impact, e.g. by falling to the ground with the hammer at rest, inasmuch as the pistol is not provided with an inertia-striker and the hammer, hitting against the ground, operates the striker itself to cause the burst-firing.

SUMMARY OF THE INVENTION

It is therefore an object of the present invention to provide an improved automatic pistol capable of burst-firing, which does not have the drawbacks of the known pistols of this type, and which is also light and handy, simple and in operation and absolutely safe.

Another object of the present invention is to provide an improved automatic pistol with a burst-firing device, together with means for cooling its barrel.

The improved automatic pistol with burst-firing device according to the invention, substantially comprising a grip safty sear, connected to a release lever protruding from the rearside of the handgrip and adapted to engage a disk integral with a hammer, a sear capable of being locked and released by a disconnector, a trigger bar connected to the trigger and cooperable with said disconnector, a breech mechanism, an extractor and heat-exchanging means for cooling the pistol barrel, is characterized by the fact that said disconnector, hinged to said breech mechanism, is chamfered and bent at its end opposite to said sear, for co-operation with said trigger bar, there being further provided a selector member driven from outside and adapted to hold the position of said trigger bar to enable burst firing.

BRIEF DESCRIPTION OF THE DRAWINGS

The invention will be described now more in detail, by way of non-limiting example only, with reference to a preferred embodiment thereof, shown in the annexed drawings, wherein.

DETAILED DESCRIPTION OF THE PREFERRED EMBODIMENT

Figure 1:
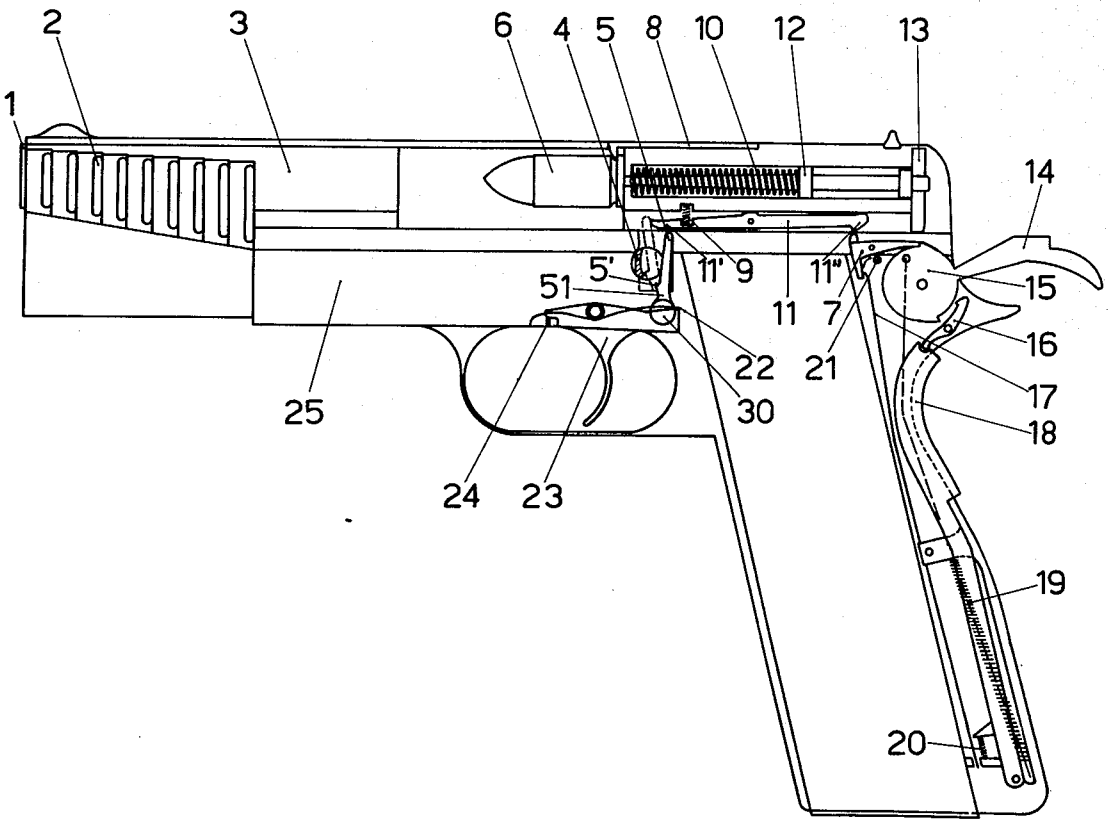
FIG. 1 is a side view, with broken away portions, of a pistol according to the present invention in usual repeating fire condition.

With reference to FIG. 1, illustrating a preferred embodiment of the pistol according to the present invention, in a burst-firing condition, there are shown a grip safty sear 16 connected to a lever 18, a hammer 14 integral with a disk 15, a percussion or striker pin 12, a sear 7, a disconnector 11, a trigger bar 5 and a trigger 23. As appears from FIG. 1, the grip safety sear 16 is released by taking up the pistol and applying pressure against the handgripping and lever 18, the lever 18 being biased into a rest position by a spring 20.

The hammer 14 is thrusted against the percussion pin by the integral disk 15, under the tractive force of a spring 19. The sear 7 is usually locked by means of a safety ratchet pawl 21. On the other hand, the sear 7 may be released by disconnector 11 when the ratchet pawl 21 is positioned as in FIG. 1. The trigger bar 5, which is kept in vertical position by a spring 22, has two degrees of freedom, namely vertical movement under the action of the spring 22 and rotation about a pin 30 connecting the trigger bar 5 to the trigger 23.

FIG. 1 shows also a selector member 4, substantially comprising rotatable plate capable of having two operation positions, a first position illustrated in FIG. 1 enabling pivotal movement of trigger bar 5 in a forward direction and a second position rotatable upon rotation of selector member 90° (in a counter-clockwise direction from the position illustrated) limiting the upwards stroke of trigger bar 5 in a direction substantially perpendicular to the axis of the control lever 11 and preventing forward pivotal movement of trigger bar 5.

Bearing in mind what has been stated above, it is easy to understand the repeat-firing operation of the pistol according to the present invention. Once the pistol is gripped, the sequence of movements of the movable elements which have been described, is as follows: upon releasing the grip safety sear 16 from its usual safety position by means of a slight pressure on the lever 18, a user presses the trigger 23, thus causing trigger bar 5 to rise vertically. The trigger bar 5 thrusts the end 11' of disconnector 11 upwardly and this in turn, through the other end 11'' of disconnector 11 disengages the sear 7 and releases hammer 14.

The hammer 14 is driven by the disk 15 due to the action of the spring 19, and strikes the percussion pin 12 which advances, against the force of a counter spring 10, to strike cartridge 6 in the pistol barrel 1. Upon firing the breech mechanism recoils and slides rearwardly and extracts the cartridge case by means of the extractor 8 and resets the hammer 14.

On recoil, the breech mechanism 3 causes another cartridge to be placed in firing position in the barrel 1.

Disconnector 11 is pivotedly mounted on the breech mechanism 3, and reciprocates therewith, and, during the backward stroke, returns to the position illustrated in FIG. 1 under the bias of the spring 9. Upon return of the breech to the position illustrated in FIG. 1, disconnector 11 engages trigger bars driving it forwardly (as shown by dashed lines at FIG. 1). In order to repeat a shot it is necessary to release the trigger 23 so that trigger bar 5 is allowed to lower and the spring 22 can bring it again to the vertical position below the end 11' of disconnector 11,. In this situation, the trigger can be again pressed to repeat a shot.

It is to be pointed out that the combination of the sear 7 and grip safety latch 16, together with the ratchet pawl 21, affords the greatest reliability and safety, required for bringing the hammer 14, as usually happens, from the rest to the firing position by employing only one hand and placing the thumb thereof on the hammer head.

Figure 3:
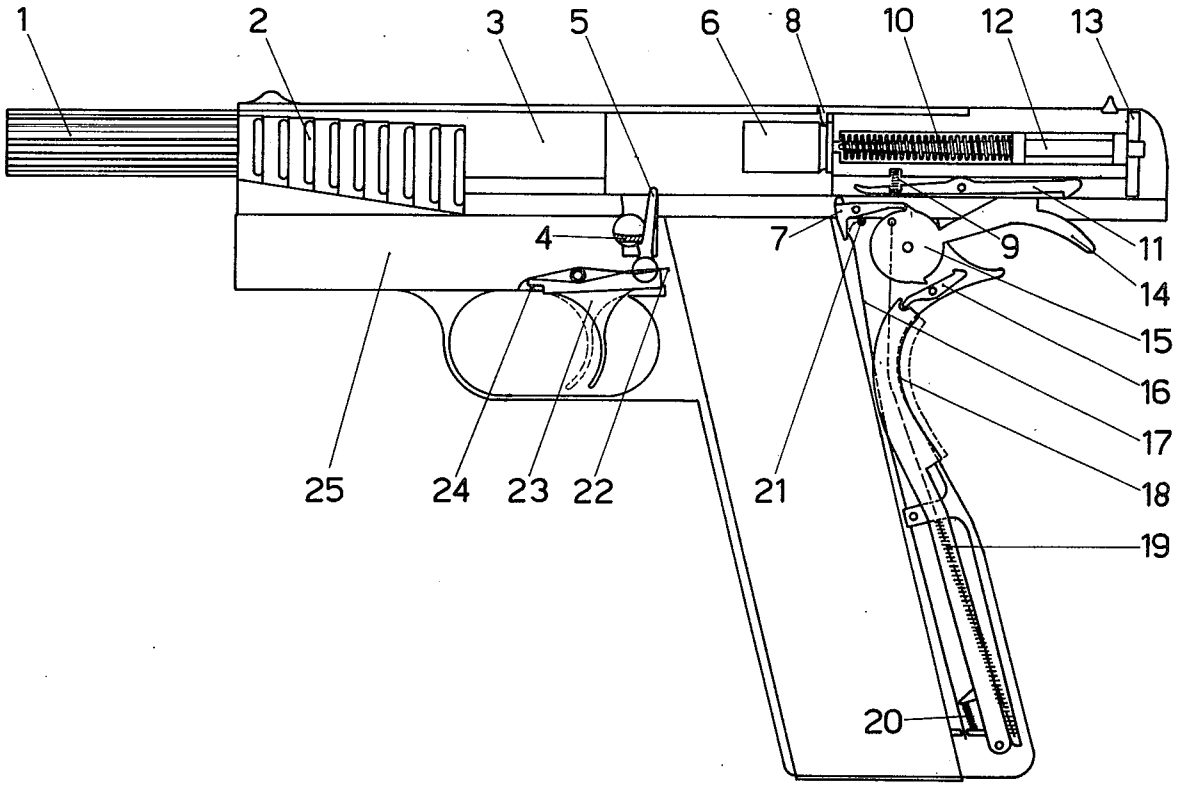
FIG. 3 is a side view similar to FIG. 1 of the same pistol in burst-firing condition.

FIG. 3 shows the automatic pistol of FIG. 1 during the burst-firing condition. The only difference between the two conditions resides in the position of the stop selector member 4, which is rotated 90° in a counterclockwise direction. The firing sequence is quite similar to that already described, except that in this situation, while pressing the trigger 23, the trigger bar has only one degree of freedom and is locked during its upwards motion by a shoulder 5', formed in its shank 51, which engages selector member 4. However, the trigger bar 5, upon pressing the trigger moves a sufficient vertical distance to operate the disconnector 11 and therefore fire a cartridge. After recoil and during return of the breech the disconnector 11 engages the trigger bar 5 along its curved end which is suitably bent and chamfered (and not perpendicularly as occurs for the operating condition described in connection with FIG. 1). As a consequence, disconnector 11 is maintained out of engagement with sear 7 and enables the mechanism to repeat automatically the firing movements. The trigger bar 5 cannot rotate around the axis 30 since the selector member 4 keeps it locked in its vertical position. In this way, by keeping the trigger pressed during different time intervals, it is possible to fire automatically a volley of two or more cartridges, or all those contained in the magazine.

Figure 2:
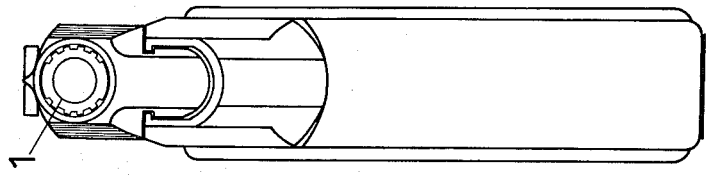
FIG. 2 is a front view of the pistol of FIG. 1.

FIGS. 1 and 3, as well as FIG. 2, illustrate a number of air intakes 2 formed in the breech mechanism 3. This arrangement allows the breech mechanism, by means of its reciprocating movement, to air and cool the barrel. In particular, the front view of FIG. 2 illustrates the frusto-pyramidal shape of the breech mechanism 3 along the whole length of the cooling air intake section. Furthermore, the barrel 1 of the pistol according to the invention as illustrated, is formed with an outer finning in order to facilitate the exchange of heat.

Figure 4:
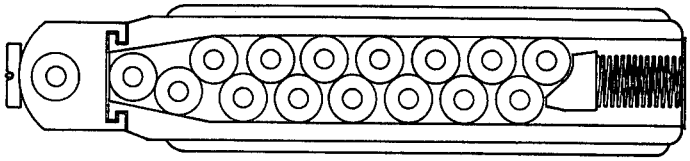
FIG. 4 is a view from the back side, partly broken away, of the same pistol.

Finally, FIG. 4 shows a rearside view, parts broken away of the pistol of the present invention. According to the embodiment of FIG. 4, the pistol can be loaded with sixteen cartridges, of which fifteen in the magazine and one in the barrel.

While the present invention has been described in detail with reference to the annexed drawings and to a preferred embodiment of the same invention, it is obvious that variations and/or modifications can be made to said embodiment by those skilled in the art without departing from the scope and spirit of the invention itself.

What I claim is:

1. An automatic pistol having repeat and burst firing modes of operation comprising:

a pistol frame, a barrel carried by said frame, a slide carried by said frame for reciprocating movement between a pistol firing position and a recoil position, means for firing said pistol including a striker pin carried by said slide, a hammer and a sear carried by said frame, said sear being mounted for movement between a first position normally engaged with said hammer to prevent said hammer from striking said pin and a second position disengaged from said hammer for release thereof to enable said hammer to strike said pin, a trigger carried by said frame, a disconnector carried by said slide for reciprocating movement therewith and for movement between first and second positions, said disconnector in said second position being engageable with said sear enabling said sear to move into its second position thereby to release said hammer for firing said pistol, means carried by said trigger and responsive to a pull on said trigger to move said disconnector from said first position into said second position thereby enabling the pistol to be fired and, in response, said slide to be reciprocated from said firing position to said recoil position and back, said sear being movable into its first position upon movement of said slide from said firing position to again engage said hammer and prevent it from striking said pin for a second shot, means biasing said disconnector for movement into said first position, said disconnector lying in its first position under the action of said biasing means when, after firing, said slide returns to its firing position thereby preventing the pistol from firing until the trigger is once again pulled to move said disconnector into its second position, and a manually movable selector member carried by said frame for selecting a repeat firing or burst firing mode of operation for said pistol, said selector member, when moved to said burst firing mode of operation, being cooperable with said moving means for automatically moving said disconnector into said second position upon each return of said slide to its firing position thereby repeatedly moving said sear into its second position, releasing said hammer, and enabling burst firing of said pistol.

2. An automatic pistol according to claim 1 wherein said moving means includes a trigger bar mounted for movement into and out of the path of movement of said disconnector upon reciprocating movement of the slide, said disconnector and said trigger bar having cooperating cam surfaces for moving said disconnector into its second position upon return of the slide to the firing position when said selector member is moved to burst firing mode of operation.

3. An automatic pistol according to claim 2 wherein said trigger bar is mounted for pivotal movement in the direction of return of the slide, said trigger bar being engageable with said disconnector to move said disconnector from its first position and into its second position, in response to pulling said trigger, said disconnector engaging said trigger bar to pivot it forwardly upon return of said slide, said trigger bar being movable from out of the path of movement of said disconnector upon release of said trigger when said selector member lies in the repeat firing position.

4. An automatic pistol according to claim 3 having means cooperating between said selector member and said trigger bar, when said selector member lies in said burst firing mode of operation, to lock said trigger bar in the path of movement of said disconnector whereby said trigger bar moves said disconnector from its first position into its second position upon each return of said slide to its firing position.

5. An improved automatic pistol according to claim 1, wherein said heat-exchanging means for cooling the pistol barrel comprises a plurality of air intakes provided on both sides of the breech mechanism, having a trunk-of-pyramid shape.

6. An improved automatic pistol, according to claim 5, wherein said barrel is provided with outer radial finnings forming flow chambers for the air entering through said air intakes of the breech mechanism.

* * * * *